US008068022B2

(12) United States Patent
Ben-Itzhak et al.

(10) Patent No.: US 8,068,022 B2
(45) Date of Patent: Nov. 29, 2011

(54) SYSTEM AND METHOD FOR MONITORING OBJECTS AND PEOPLE USING A MOBILE DEVICE

(75) Inventors: Yaniv Ben-Itzhak, Kefar Saba (IL); Aviv Amiri, Michmoret (IL)

(73) Assignee: Penteye Technologies Ltd, Granot (IL)

( * ) Notice: Subject to any disclaimer, the term of this patent is extended or adjusted under 35 U.S.C. 154(b) by 882 days.

(21) Appl. No.: 11/836,155

(22) Filed: Aug. 9, 2007

(65) Prior Publication Data

US 2009/0040040 A1 Feb. 12, 2009

(51) Int. Cl.
*G08B 1/08* (2006.01)

(52) U.S. Cl. ..... 340/539.13; 340/539.26; 340/524; 340/568.1; 340/573.1; 340/573.4; 455/41.2; 455/456.1

(58) Field of Classification Search ..... 340/539.13, 340/539.26, 524, 568.1, 573.1, 573.4; 455/41.2, 455/456.1

See application file for complete search history.

(56) References Cited

U.S. PATENT DOCUMENTS

| | | | | |
|---|---|---|---|---|
| 5,021,794 | A * | 6/1991 | Lawrence | 342/457 |
| 5,485,163 | A * | 1/1996 | Singer et al. | 342/457 |
| 5,870,029 | A * | 2/1999 | Otto et al. | 340/825.36 |
| 6,828,908 | B2 * | 12/2004 | Clark | 340/539.13 |
| 7,015,817 | B2 * | 3/2006 | Copley et al. | 340/573.4 |

* cited by examiner

*Primary Examiner* — Tai T Nguyen

(57) ABSTRACT

A system for monitoring the location of persons or objects using a wireless device, comprising at least one tag unit capable of transmitting data signals of a first type identifying said at least one tag; a wireless device capable of receiving data signals of a second type; and a converter unit, that receives the data signals of the first type from said at least one tag unit, converts the data signals of the first type to data signals of a second type, and transmits said data signals of a second type to the wireless device.

19 Claims, 6 Drawing Sheets

SYSTEM AND METHOD FOR MONITORING OBJECTS AND PEOPLE USING A MOBILE DEVICE

FIELD OF THE INVENTION

The present invention relates generally to the field of monitoring objects and people location and more particularly to a system and method for monitoring objects and people location through a mobile wireless device.

BACKGROUND OF THE INVENTION

There is a need to monitor the location of objects and people, especially children. The most common scenario occurs where a parent or a supervising person is located with his children or supervised persons in a crowded site such as a mall, amusement park, airport, museum, or beach. In such event, the parent/supervisor faces a significant difficulty in keeping the children/supervised persons in his vicinity while allowing other children or persons in his supervision to wander in the proximate vicinity. For example, a supervising adult may find it difficult to supervise each of three children wishing to view different pictures in a museum or wishing to enter different stores in a mall. One of the common scenarios is a parent being occupied and concentrated in a mobile phone call, loosing contact with one or more children during the phone call.

There are existing solutions to the need to keep track of children or other objects location, such as the commercially known "ionkids" system. "ionKids" allows parents to monitor the locations of up to four kids via splash- and tamper-resistant wrist tags that transmit a radio signal to a base unit by which their proximity is determined. See www.ionkids.com.

However, existing solutions are limited in practicality due to the fact that they make use of a dedicated control and monitoring device that is both expensive and relatively heavy and large in size.

There is therefore a need for a monitoring system that communicates with common mobile devices and particularly with personal digital assistant devices (PDA) typically mobile or wireless phones and preferably responsive to a child or object getting farther during a phone call session.

There is a need for a monitoring system that exploits the capabilities of existing wireless devices such as mobile phone and other PDA or handheld devices.

SUMMARY OF THE INVENTION

An aspect of an embodiment of the subject matter relates to a system and method for monitoring the location of a person or object, using a wireless handheld device, such as mobile phone or handheld computer for both getting an indication when a predefined distance threshold is crossed and acting upon this information using the wireless mobile communication device.

An aspect of an embodiment of the subject matter relates to a system and method for monitoring the location of a person or object by providing each person or object with a tag unit that transmits data signals of a first type, e.g. RF transmission, where the data signals carrying unique identification information for each tag unit, to be received by a converter unit that converts the received data to data signals of a second type, e.g. Bluetooth data signals to be transmitted to a wireless handheld device, e.g. a mobile phone that is adapted to receive the data signal of the second type, process the information that is carried by the data signal of the second type and display indicative information on the distance of each of the tag units from the converter unit.

There is thus provided in accordance with an exemplary embodiment of the subject matter a system for monitoring the location of persons or objects using a wireless device, comprising at least one tag unit capable of transmitting data signals of a first type identifying said at least one tag; a wireless device capable of receiving data signals of a second type; and a converter unit, that receives the data signals of the first type from said at least one tag unit, converts the data signals of the first type to data signals of a second type, and transmits said data signals of a second type to the wireless device.

In some embodiments of the subject matter the converter unit further extracts data from the data signals of the first type.

In some embodiments of the subject matter the data signals of the second type are responsive to the data that was extracted from the data signals of the first type.

In some embodiments of the subject matter the data signals of a first type are RF signals.

In some embodiments of the subject matter the first type data signals are RF signals operated with compliance to ZigBee protocol.

In some embodiments of the subject matter the wireless device is a handheld device In some embodiments of the subject matter the wireless device is a mobile phone device.

In some embodiments of the subject matter the second type data signals are Bluetooth protocol compliant signals.

In some embodiments of the subject matter the converter unit extracts indication of the distance of each of said at least one tag units from said converting unit.

In some embodiments of the subject matter the converter unit extracts indication of the distance of each of said at least one tag units from said converting unit, based on the intensity of the signals that are received from each of said at least one tag unit.

In some embodiments of the subject matter the data signals of the second type include indication on the distance between a tag unit and the converter unit.

In some embodiments of the subject matter the at least one tag unit is capable of receiving data signals of the first type; the wireless device is capable of transmitting data signals of the second type; and the converter unit further receives the data signals of the second type from the wireless device converts the data signals of the second type from the wireless device to data signals of the first type, and transmits said data signals of the first type to said at least one tag unit.

In yet other embodiment of the subject matter there is provided an apparatus of converting signals associated with Monitoring persons or objects, comprising: a receiver unit for receiving a first type data signals from at least one tag unit that is attached to a person or object that is being monitored and processing data that is derived from said first type data signals; a converter unit for converting the first type data signals to a second type signals; a transmitter unit for receiving data from said converter unit, and transmitting the second type data signals to a wireless device.

In yet other embodiment of the subject matter there is provided a system for monitoring the location of persons or objects using a common wireless device, comprising at least one tag unit capable of transmitting data signals identifying said at least one tag; a common wireless device capable of receiving data signals from said at least one tag unit, wherein said common wireless device displays indication on the distance of said at least one tag unit from the said common wireless device according to the intensity of said data signals that are received from said at least one tag unit;

In some embodiments of the subject matter there is provided a method of monitoring the location of persons or objects, comprising the steps of: transmitting first type signals from at least one tag unit that is attached to a person or object that is being monitored; receiving the first type signals by a converter unit; converting the first type signals into a second type signals; and transmitting signals of a second type to a wireless device, wherein the signals of the second type are responsive to the signals of the first type that were received by the converting unit.

In some embodiments of the subject matter the method further comprises a step of extracting indication of the distance between each of said at least one tag unit and the converter unit.

In some embodiments of the subject matter the method further comprising displaying indication on the distance of said at least one tag unit from said converting unit by said wireless device.

In yet other embodiment of the subject matter there is provided a computer readable storage medium containing a set of instructions for a handheld computing device, the set of instructions comprising: at least one input component for receiving indicative data that is associated with at least one person or object and includes indication of the distance of said at least one person or object and a unique identification of said at least one person or object; at least one calculating unit for processing said indicative data; and graphic user interface for displaying information responsive to the distance of said at least one persons or object.

BRIEF DESCRIPTION OF THE DRAWINGS

The present invention will be understood and appreciated more fully from the following detailed description taken in conjunction with the drawings. Identical structures, elements or parts, which appear in more than one figure, are generally labeled with a same or similar number in all the figures in which they appear, wherein.

DETAILED DESCRIPTION OF THE INVENTION

The invention generally relates to a system, method, and software for monitoring people and objects location through mobile devices.

For clarity of the description, a non-limiting example of a people's location monitoring system is described as an exemplary embodiment of the invention. In the context of the present invention, the use of the term children also refers to any supervised person, including animals, objects, incapacitated persons, prisoners, parolees and the like.

Figure 1:
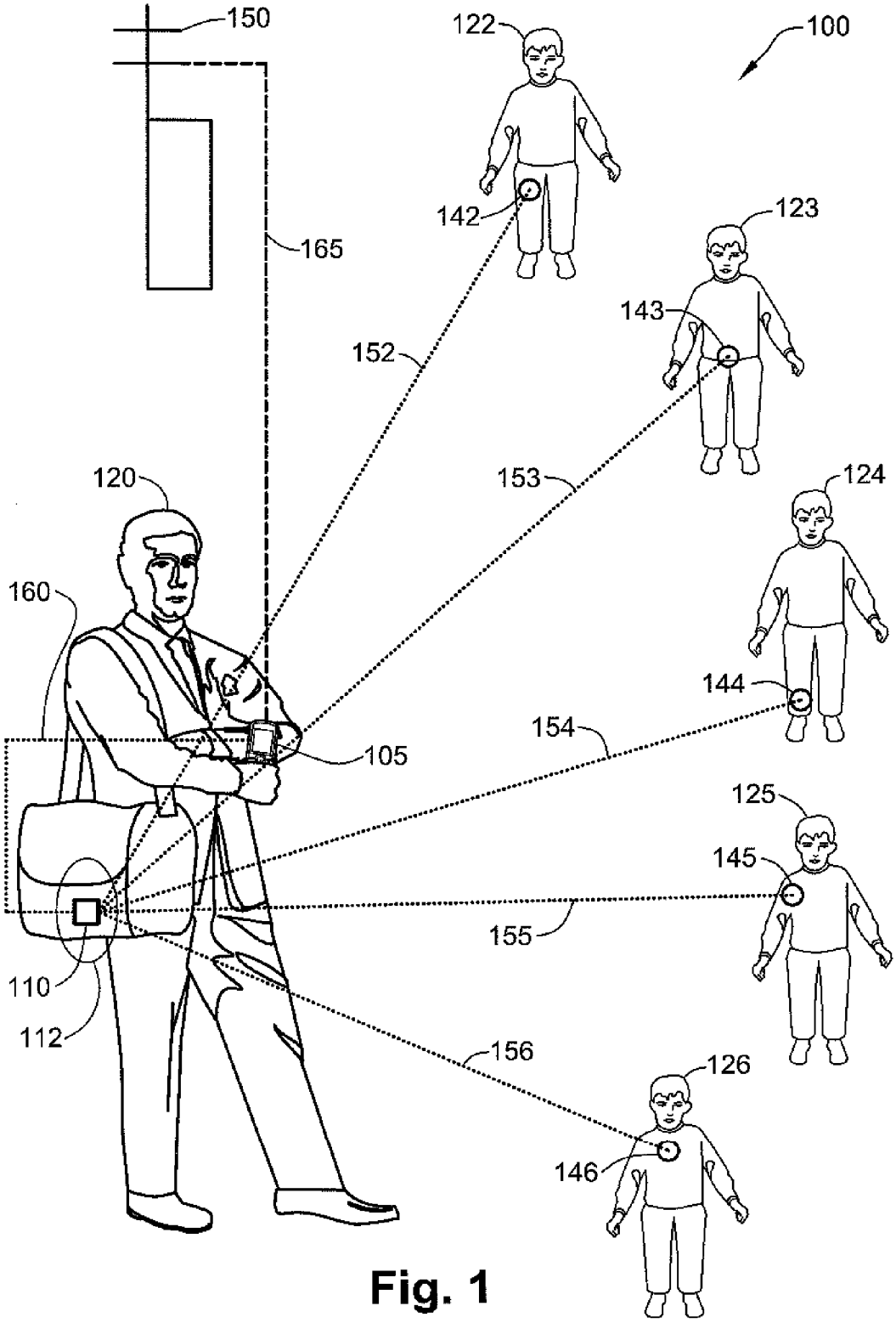
FIG. 1 is a schematic illustration of a system deployment according to an exemplary embodiment of the subject matter.

Turning now to FIG. 1, showing a schematic illustration of the system deployment 100 according to an exemplary embodiment of the subject matter. The system 100 includes five tag units 142,143,144,145, 146 that are attached to five children 122,123,124,125, 126 respectively. For the purpose of convenience reference will only be made to tag unit 142 and child 122, although it will be clear to those skilled in the art that the following description applies to each shown tag. The tag unit 142, as will be further described in detail is of a size of a few centimeters and can be worn as a bracelet, be put in a pocket or hidden in a shirt's collar or a pant's belt, shoe and the like.

In an exemplary embodiment of the subject matter, each of the tags unit is transmitting short data signals in Radio Frequency (RF) transmissions containing information that enables to identify the specific tag unit. Such information can for example include a unique id associated with each tag. Each of the tag units 142, 143, 144, 145, 146 optionally adds to their transmission indication on the tag unit's battery condition (e.g. full, half empty, weak).

In an exemplary embodiment of the subject matter the tag 142 transmits additional data such as the voice of the child, through the transmission of audio strings from a microphone located in the tag (not shown), such as a video picture through the transmission of video string from a camera located in the tag (not shown), the skin temperature, heart rate, of each child and other indicators of the monitored person health or condition.

The data signals transmission of each of the tag units 142, 143, 144, 145, 146 is intercepted by an RF receiver that is part of a converter unit 110. The converter unit 110 is preferably carried by a supervising person 120. In an exemplary embodiment of the subject matter the converter unit 110 has a shape of a rectangular box having dimensions of a few centimeters in length, width and height. The converter unit may be carried on a key holder, put in a wallet or small handbag 112, or carried in a pocket of a shirt or trousers. In other exemplary embodiments of the subject matter, the converter unit 110 can be a part of the mobile or wireless device carried by the supervising person.

In an exemplary embodiment of the subject matter the converting unit 110 receives the RF transmission from each of the tag units 142, 143, 144, 145, 146 and identifies the transmission source. The transmission source is preferably one of the said tags. The converter unit further monitors the intensity of the received RF transmissions. The information about the RF received transmissions intensity is later used for getting indication on the distance of each of the tag units from the converter unit. The converter unit then processes the information from the RF received transmission, optionally adds data such as the condition of the converter unit's battery, converts it to Bluetooth protocol and frequency and transmits the information according to Bluetooth protocol to a mobile phone device 105 that is adapted to receive the Bluetooth data.

The mobile phone device (105) processes the received signals by using a software application that is adapted to run under a programmable operating system (OS) of mobile phones or any PDA device, (e.g. "Symbian" or "Windows Mobile") and displays indication on the distance of each of the tag units from the converter unit, and optionally displays additional data such as tag units and converter battery condition. The display unit optionally includes audio alarms capabilities to alert the supervising person 120 on critical events such as the loss of signal from one or more tag units, or significant decrease in the intensity of the signal that is received from one or more of the tag units 142, 143, 144, 145, 146.

The mobile phone 105 keeps track of the tag units 142,243, 244,245,146 and simultaneously enables the normal usage of mobile phone connection to a mobile network 165.

It should be noted that while FIG. 1 shows a monitoring system that includes five tag units, in other exemplary embodiments of the subject matter the monitoring system may include more or less tag units. For example a school class teacher may use a monitoring system that includes forty tag units in order to monitor al the pupils in the class. In other exemplary embodiments of the subject matter a single tag unit can be monitored by a supervising person.

Figure 2:
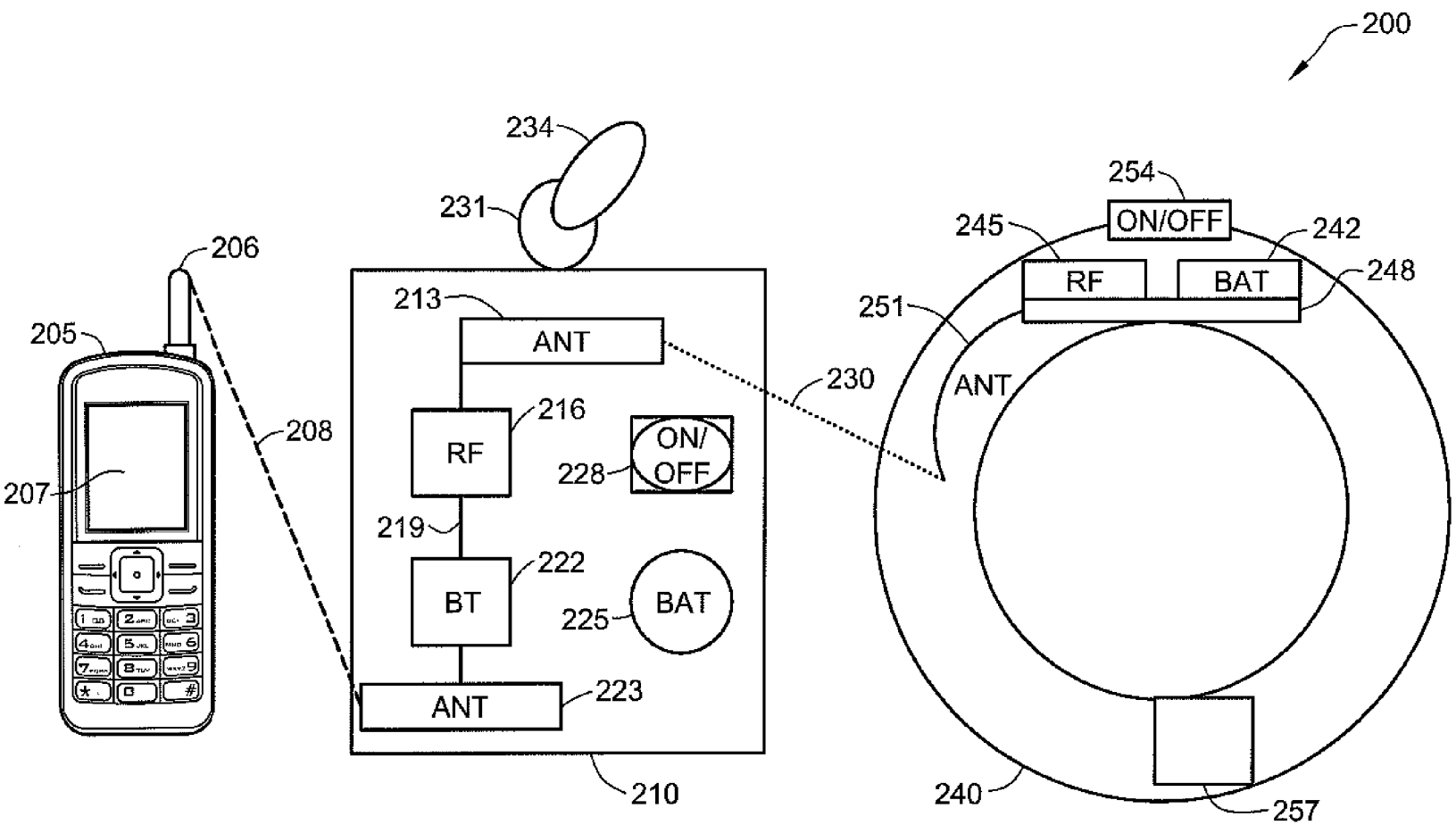
FIG. 2 is a detailed illustration of three main units of the system, including a tag unit, a converter unit and a mobile phone device according to an exemplary embodiment of the subject matter.

Turning now to FIG. 2 showing a detailed illustration of three main units of the system 200 comprising a tag unit 240, a converter unit 210 and a mobile phone device 205.

In an exemplary embodiment according to the subject matter, the tag unit 240 is designed as a bracelet that is sealed to be water proof and is adjustable via a buckle 257. Other exemplary tag units can be designed as a watch, a carry on device enclosed in a housing, a pin or sticker having surfaces comprising attaching elements such as glue, Velcro, hooks and the like. The tag unit includes an RF transmitter unit 245 and a battery 242 preferably located on an electronic circuit board 248 that connects the RF transmitter unit to an RF antenna 251.

In an exemplary embodiment of the subject matter the RF unit enters its active state by pushing an on/off push-bottom 254. Upon activation the RF transmitter unit 245 starts to transmit periodical RF data signals which include a unique data string that enables it's identification by the converter unit 210. Exemplary periodic RF transmissions can be sent between about every 1-20 seconds depending on a predetermined setting, battery status, and other programmable settings, such as time of day, location, if a GPS unit is attached to the tag as well (not shown), and the like The RF transmitter unit 245 optionally transmits data signals that include indication on the battery 242 condition and preferably other conditions associated with the monitored person. The RF data signals are transmitted from an RF transmitter 245 via an RF antenna 254 and are received by an RF antenna 213 that is located in the converter unit 210.

The transmission by the RF transmitter unit 245 may be performed according to various transmission protocols.

It should be noted that in order to equip the converter with a small and light battery and still being able to guarantee reasonable continuous working time (e.g. eight hours) without recharging or replacing a battery, it is important to use a transmission protocol that is characterized by low power consumption and preferably also to avoid short period intervals between transmissions.

While the transmission from the tags to the converter (and optionally also vice versa) are not required to comply with any standard protocol, any method or protocol that is characterized by low power consumption and still enables connection over a range of few tens of meters is suitable for use according to the invention. In an exemplary embodiment of the subject matter the transmission from the tag units 142, 143, 144, 145,146 to the converter unit 210 is performed via a private proprietary protocol in the frequency band of 2.4-2.4835 GHZ.

In another exemplary embodiment of the subject matter the transmission from the tag units 142, 143, 144, 145,146 to the converter unit 210 is performed via a private proprietary protocol in the frequency band of 433 MHz.

In another exemplary embodiment of the subject matter the data transmission between the tag unit 240 and the converter unit 210 is handled according to the ZigBee protocol in the frequency band of 2.4-2.4835 GHz.

While optionally the system includes many tags (e.g. a school class of forty pupils) there is a need to synchronize between the transmissions of the tags. There are several methods to resolve the synchronization issue.

In an exemplary embodiment, the tag transmission is performed randomly, while the duration of each transmission is at the order of few hundreds of microseconds the probability of collisions is low and the system is adapted to ignore collision events, as long as the number of failed transmissions per second from a certain tag is not high the system will guarantee proper functionality.

In another exemplary embodiment, the converter unit 210 transmits a synchronization signal at predefined intervals, the tag units are equipped with RF receivers; i.e. the transmitter unit 245 is implemented as a transceiver for transmitting and receiving the RF synchronization signal. In accordance with this embodiment, the receiver 216 in the converter unit is implemented as a transceiver. The tag units that receive the converter's synchronization signal wait a predefined waiting period and then transmit their respective signal. The waiting period varies from tag to tag and is unique for each tag according to its ID, thus guaranteeing collision free transmission.

In another exemplar embodiment, each of the tag units is equipped with a receiver. The tags are transmitting at random intervals and are able to detect a collision between tags by listening to the channel. In case that a collision was detected by a certain tag, it will transmit again after a random delay period.

In another exemplary embodiment, the RF transmitter unit 245 is replaced by an RF transceiver that is capable of receiving RF transmissions from the converter unit 210. The ability to also receive RF transmissions is important for features such as remote activation/deactivation by the supervising person 120 and for direct communication between the monitored and monitoring persons, such as through the transmission of voice commands to the monitored person. According to this embodiment, the tag unit also comprises an internal speaker (not shown) and is able to convert data sent to the tag which comprises audio signals to be sent to the internal speaker.

In an exemplary embodiment of the subject matter transmissions from the tag unit 240 are received at the RF antenna unit 213 and processed in an RF receiver unit 216. The RF receiver unit 216 performs several functions, such as RF signal reception, extracting the identity of the transmitter, extracting indication on the distance of the tag unit which is performed by a received signal strength indication (RSSI) module. Optionally, the receiver unit 216 also extracts indication on the tag unit's battery condition and additional data that is transmitted from the RF unit of the tag 245.

It should be noted that additional information may optionally be included in the received RF transmission, for example an optional distress messaging may be included in the RF transmission. This feature is useful for a child that becomes worried when loosing eye contact with his parents or teacher (supervising person) and enables the supervising person to immediately approach the child. In another example, distressed mental or ambulatory patients may use this feature to summon the aid of a supervising person, such as a nurse; inmates or parolees or other monitored persons may contact the police or other law enforcement agencies.

In an exemplary embodiment of the subject matter the receiver unit 216 further performs verification of the data correctness and optionally also implements error correction. These functions of verifying correctness of the data and error correction by applying cyclic redundancy check (CRC), Checksum or other communication algorithms are known in the art and hence will not be described in detail.

The RF receiver unit 216 further sends the data through a serial link 219 to a Bluetooth unit 222. The Bluetooth unit converts the data from the serial link 219 to Bluetooth protocol transmission that is transmitted through a Bluetooth antenna unit 223.

The Bluetooth transmissions 208 are received in a mobile phone or other wireless device 205 as any regular Bluetooth transmission and are processed by software (S/W) application that runs under a programmable operating system such as "Symbian" or "Windows mobile". The S/W application serves to display tag unit tracking data on the mobile phone or wireless device screen 207. The S/W application preferably further implements a Graphical User Interface (GUI) that enables the user to configure and control the monitoring system. For example, the user may activate menus that enable to add or remove a monitored person from the monitoring system, activate audio alarm option and define a threshold distance that will activate alarms.

In an exemplary embodiment of the subject matter the user may configure the monitoring system to adjust the system to a certain environment. For example, when the monitoring system is expected to be operated in an open space, where line of sight is expected to be kept at relatively long distances and therefore received data signals intensity is expected to be relatively high at a given distance—the monitoring system will be configured to "open space" mode and when the monitoring system is expected to be operated indoors (such as inside a museum) the monitoring system will be configured to "indoors" mode.

In another exemplary embodiment, the mobile phone or wireless device 205 is replaced with any personal digital assistant (PDA) that has wireless communication capabilities (referred to as wireless device). Other wireless devices having processing and wireless capabilities can also be used in the context of the present embodiment.

In another exemplary embodiment of the subject matter the mobile phone device 205 is replaced with a personal computer (PC), enabling a supervising person to work on a PC and to get an alert on each occurrence of a child getting too far. Such personal computer can have a fixed location, or can be portable.

It should be noted that while the above description refers to tag units that performs a transmission according to an RF protocol (such as ZigBee protocol) that is later converted to a Bluetooth protocol, in another exemplary embodiments according to the invention the tag unit may transmit a different type of protocol and optionally use another type of signals, such as infrared (IR), light beam, laser beam, ultrasound transmission, and the like. (Generally referred to as data signals of a first type). The above description further refers to a converter unit that converts the transmission received from the tag units to Bluetooth protocol. However, in another exemplary embodiments according to the invention the converter unit may convert the transmission that is received from the tag units to a different type of protocol and optionally use another type of data signals, such as infrared (IR), light beam, laser beam, ultrasound transmission etc. (generally referred to as data signals of a second type).

Figure 3A:
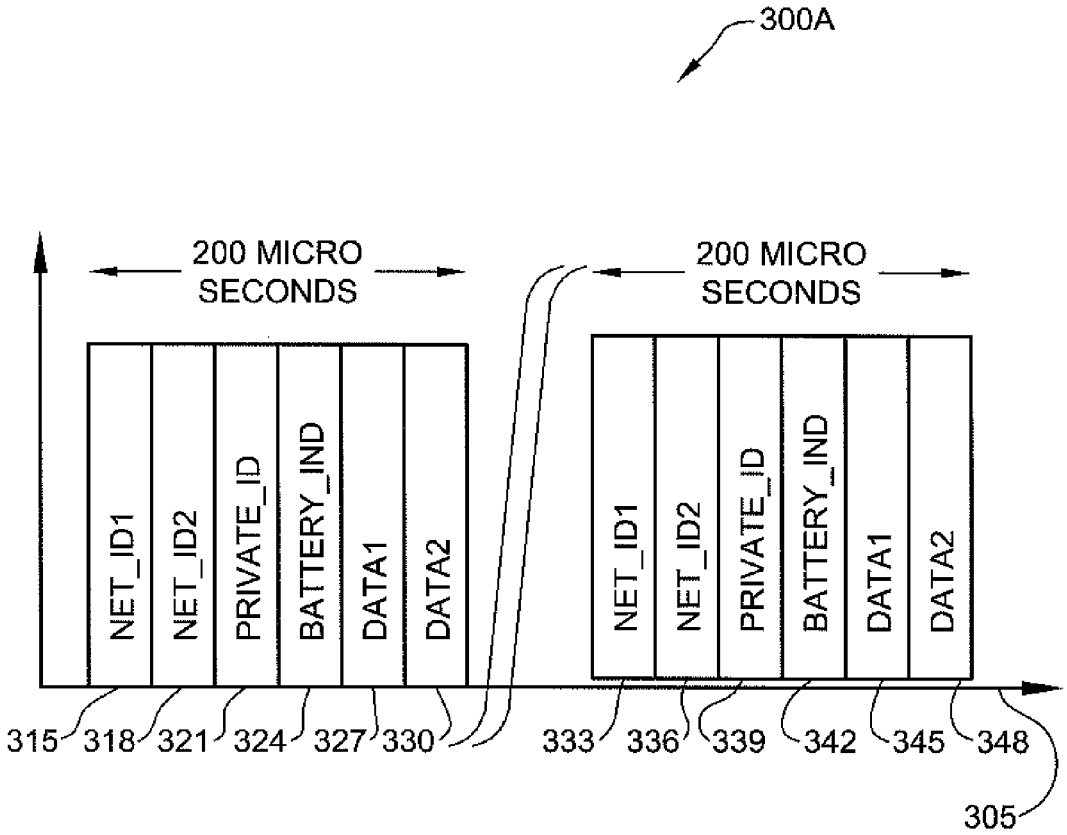
FIG. 3A is a schematic illustration of a data structure that is sent from a tag unit to the converter unit according to an exemplary embodiment of the subject matter.

FIG. 3A shows a schematic illustration of a data structure that is sent from a tag unit to the converter unit according to an exemplary embodiment of the subject matter. In an exemplary embodiment six data bytes 315,318,321,324,327, 330 are periodically transmitted from each tag unit. The data bytes 315,318,321,324,327, 330 carry data as follows: first and second data bytes 315, 318 contain a net-id number, which is a unique number that differentiates among the various systems that may operate in a certain area. The third byte 321 is a private-id that enables the system to identity up to 256 tag units, wherein each tag is typically associated with one monitored person. The fourth byte 324 is a battery indication byte that provides the converter with the condition of the battery in a specific tag unit. The fifth and sixth bytes are carrying additional data, such as alarm or temperature of the sending tag unit. In an exemplary embodiment, the duration of a tag transmission is in the order of two hundred microseconds, thus in the case that forty tags are transmitting sequentially, the total duration of a single transmission by some forty tag units is less than one hundredth of a second, which enables the tag units to transmit more than one transmission per second which is frequent enough for monitoring an active person. The bytes 333, 334, 335, 336, 337, 348 show a second transmission which might describe either another transmission of the same tag unit or a transmission of another tag unit. In an alternative embodiment the first transmission and the second transmission comprise different data types, such that the second transmission may include data such as audio recorded by the tag unit allowing the monitoring person to listen in and establish the condition of a monitored person. According to such embodiment the tag unit will also comprise a microphone for capturing audio.

Figure 3B:
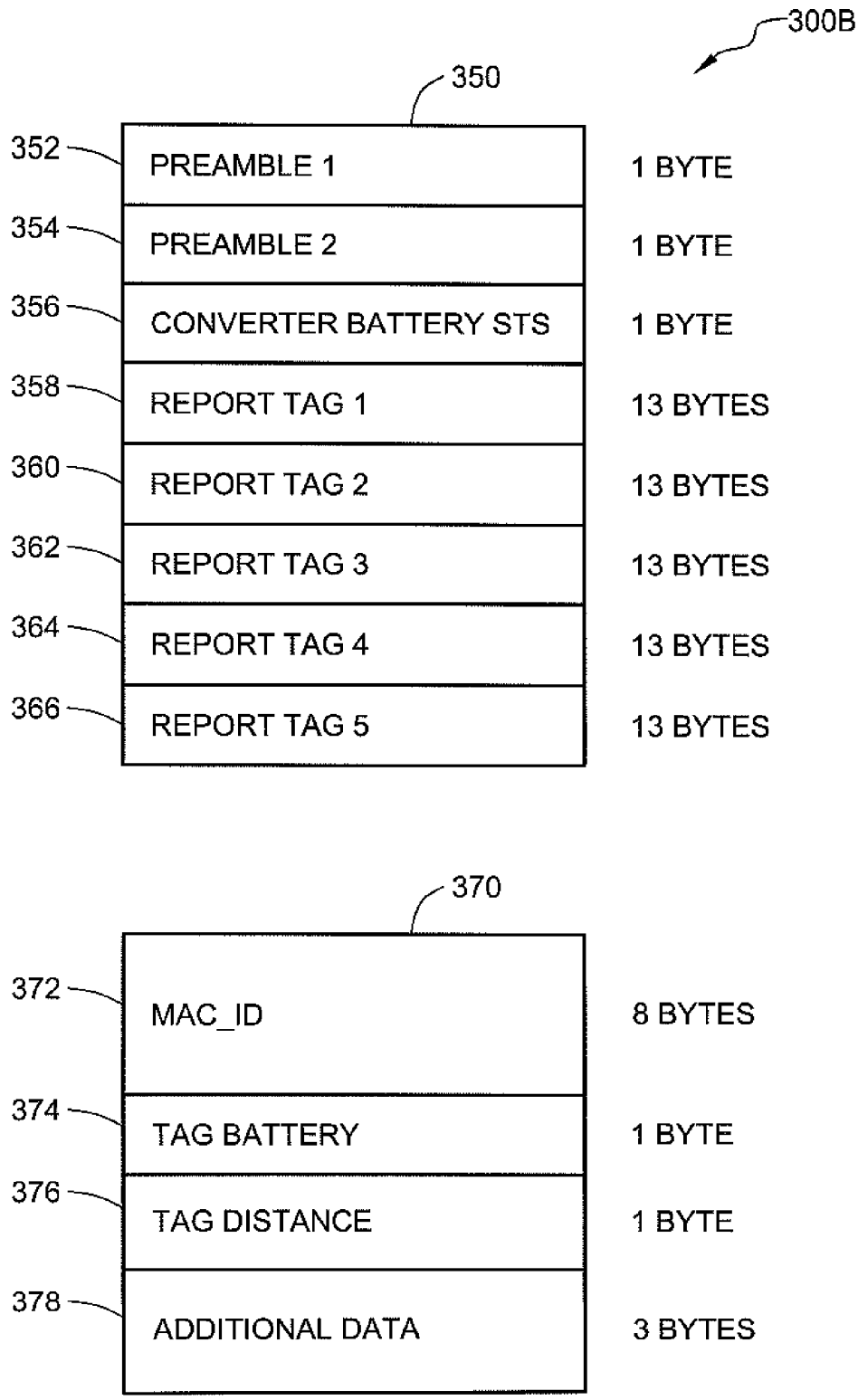
FIG. 3B is a schematic illustration of a data structure that is sent from the converter unit to the mobile device according to an exemplary embodiment of the subject matter.

FIG. 3B is a schematic illustration of a data structure that is sent from the converter unit to the mobile device. According to an exemplary embodiment of the subject matter that comprise some five tag units, the tag unit 210, periodically, according to the Bluetooth protocol specifications, sends data transmissions to the mobile phone or wireless device 205.

In an exemplary embodiment, the tag unit transmission starts with two preamble bytes 352, 354. The third byte 356 carries indication on the converter's unit battery. Each group of thirteen following bytes 358,360,362,364, 366 caries the information from one tag unit. Each tag unit's information 370 includes eight bytes of MAC ID information 372 that uniquely identifies each tag unit. The ninth byte carries information on the tag unit's battery condition 374. The tenth byte carries indication of the tag's unit distance from the converter unit 376, and the last three bytes 378 carry additional data, such as active alarm, tag's temperature etc.

In an exemplary embodiment of the subject matter, the S/W application that runs under the wireless device OS includes an input component for receiving indicative data that is associated with at least one person or object and includes indication of the distance of said at least one person or object 376, and a unique identification of said at least one person or object 372. The S/W application includes a calculating unit for processing the indicative data. For example the calculating unit optionally performs the association between the tag distance byte 376 and the actual estimated distance according to the type of media/obstacles (e.g. open space or concrete walls). The S/W application further includes a graphic user I/F for displaying information that was calculated/processed by the calculating unit, for example graphical display as is further shown in FIG. 4.

Figure 4:
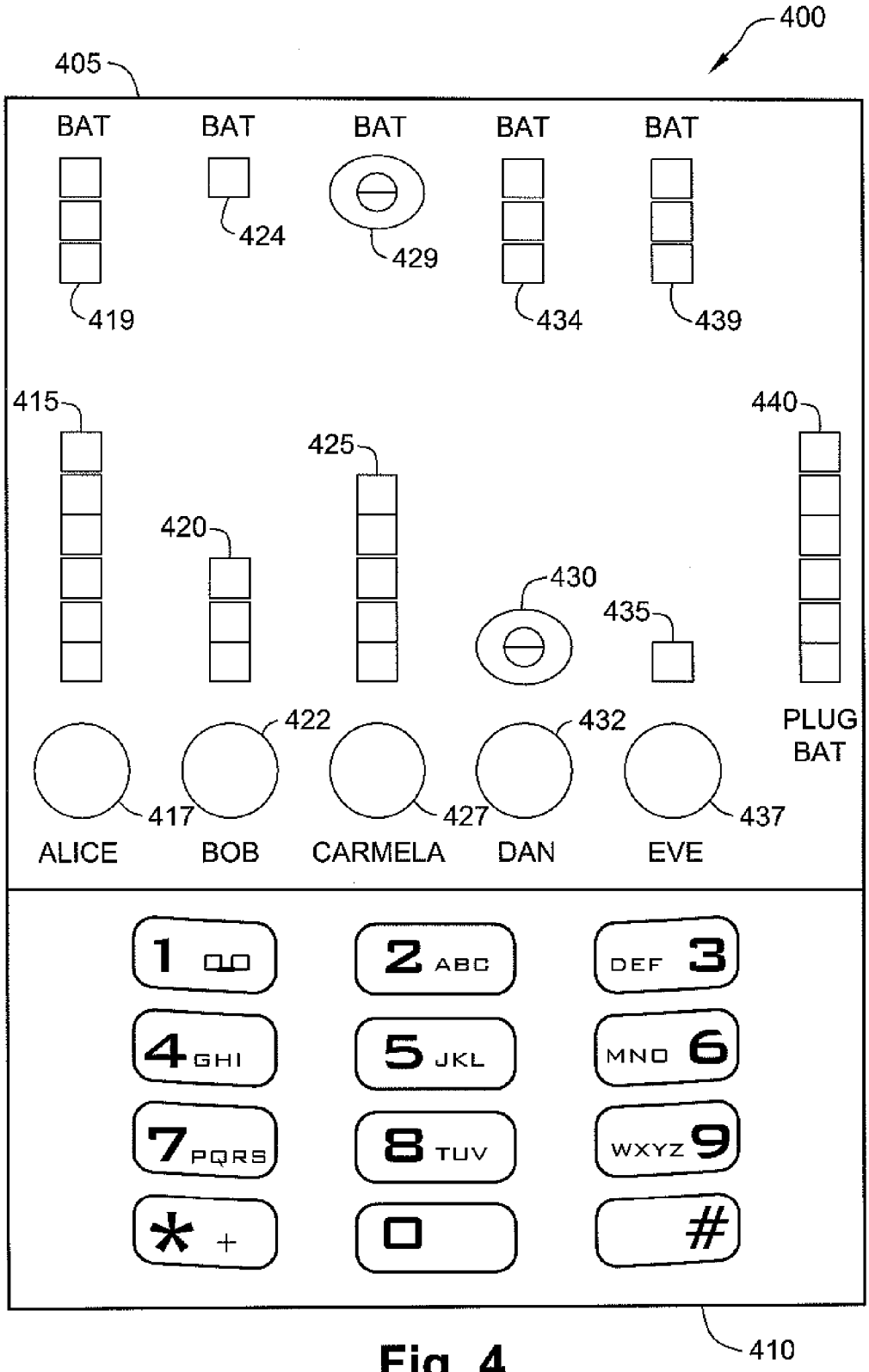
FIG. 4 is a schematic illustration of a mobile phone device display unit according to an exemplary embodiment of the subject matter.

Referring now to FIG. 4 showing a schematic illustration of a mobile phone device display unit 400 according to an exemplary embodiment of the subject matter.

In an exemplary embodiment, the screen of the mobile phone or wireless device 405 (referred to as screen) shows information related to five monitored persons: Alice, Bob, Carmela, Dan and Eve. The exemplary screen shows five distance measuring bars 415,420,425, 430, 435, wherein each distance measuring bar reflects a relative intensity of the first type signals that were received in the converter unit from the monitored person's tag unit. For example, the screen 405 shows a full distance measuring bar height—six rectangles associated with Alice's location—indicating that a relatively strong first type data signals are received from Alice's tag unit by the converter unit. The measuring bar that is associated with Bob 435 is only three rectangles height—indicating that Bob is probably located at a greater distance from the converter unit 210 than Alice. Carmela's measuring bar is five rectangles in height indicating that in high probability Carmela is closer than Bob and more far than Alice (all distances refer to the converter unit 210). Dan measuring bar is not showing any rectangular but an alert 430 meaning that there is no connection (first type data signals are not being received from Dan).

It should be noted that the intensity of signals of the first type that are received by the converter depend not only on the distance between the tag unit and the converter, but also on the signal's path, i.e. if there is a line of sight between the tag unit and the converter unit, or the type of obstacles that the signal passes from the tag unit to the converter unit. (e.g. a wooden wall, a thick/thin brick wall, a concrete wall etc.)

In an exemplary embodiment of the subject matter a measuring bar 440 provides indication on the converter's unit battery. In an exemplary embodiment of the subject matter a measuring bar is associated with the battery condition of each of the monitored persons 419,424,429,434, 439.

In an exemplary embodiment of the subject matter an audio alert is generated at each point in time that a distance measuring bar goes below a predefined threshold level.

In an exemplary embodiment of the subject matter the displays that are shown on the screen 405 have precedence over the normal display of the mobile phone and are periodically or continuously displayed on the screen even during an active phone call.

Currently mobile phones and PDA devices (referred to as common wireless devices) that are equipped with Bluetooth I/F suffer difficulties in communicating with a plurality of Bluetooth devices, and further more, it is still not practical to operate tag units according to Bluetooth protocol—due to power requirements and communication ranges. However both, the tag unit's limitations and the common wireless device's limitation, are expected to be solved.

Figure 5:
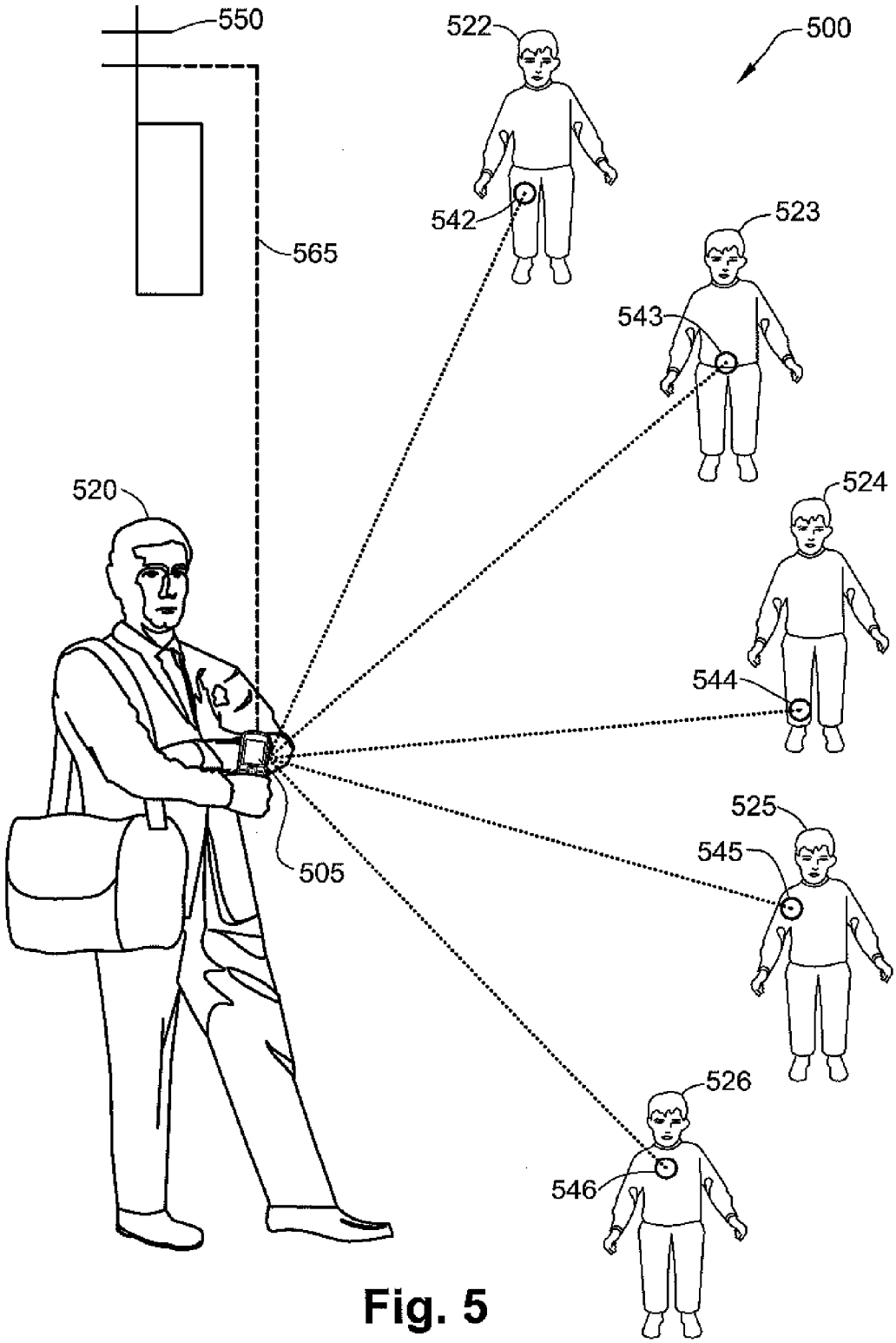
FIG. 5 is a schematic illustration of a system deployment, which does not include a converter according to an exemplary embodiment of the subject matter.

FIG. 5 shows an exemplary embodiment of the subject matter wherein there is a direct communication between each of the tag units 542,543,544,545,546 and the mobile phone 505 Each of the tag units 542,543,544,545,546 is transmitting (or optionally transmitting and receiving) Bluetooth transmissions and the mobile phone 505 is receiving the Bluetooth transmission (or optionally also transmitting Bluetooth transmissions to the tag units 542,543,544,545,546).In this embodiment of the subject matter, the mobile phone 505 needs to evaluate the tag units distance according to the intensity of the signals that are received from each of the tag units 542,543,544,545,546.

While the conversion of signal intensity to visual display is usually performed by mobile phones regarding the quality of the received RF signals, it is not described in further detail.

In an exemplary embodiment of the subject matter the transmission between the tag units 542,543,544,545,546 and the common wireless device 505 is performed by other type of protocol or radiation, such as infra-red, laser beam, optical beam, ultrasound or the like.

It should be appreciated that the above described methods and systems may be varied in many ways, including, omitting or adding steps, changing the order of steps and the type of devices used. It should be appreciated that different features may be combined in different ways. In particular, not all the features shown above in a particular embodiment are necessary in every embodiment of the subject matter. Further combinations of the above features are also considered to be within the scope of some embodiments of the invention.

Section headings are provided for assistance in navigation and should not be considered as necessarily limiting the contents of the section.

It will be appreciated by persons skilled in the art that the present invention is not limited to what has been particularly shown and described hereinabove. Rather the scope of the present invention is defined only by the claims, which follow.

We claim:

1. A system for monitoring a location of persons or objects, comprising a. at least one tag unit adapted to transmit data signals of a first type identifying said at least one tag;

b. a wireless device for receiving data signals of a second type, wherein said wireless device is carriable by a monitoring person; and c. a portable converter unit, that is carriable by said monitoring person, that receives the data signals of the first type from said at least one tag unit, converts the data signals of the first type to data signals of the second type, and transmits said data signals of the second type to the wireless device, wherein said data signals of the second type are transmitted according to a protocol that is applicable for said wireless device;

wherein said converter unit extracts indication of a distance of each of said at least one tag units from said converting unit, based on intensity of the signals that are received from each of said at least one tag unit, and wherein the wireless device displays graphic display responsive to the indication of the distance of each of said at least one tag units from said converting unit.

2. The system according to claim 1 wherein the converter unit further extracts data from the data signals of the first type.

3. The system according to claim 2 wherein the data signals of the second type are responsive to the data that was extracted from the data signals of the first type.

4. The system according to claim 1 wherein the wireless device displays graphic display responsive to the data signals of the second type that are received by the wireless device.

5. The system according to claim 4, wherein the graphic display responsive to the data signals of the second type that are received by the wireless device has precedence over other graphic displays that are displayed by the wireless device.

6. The system according to claim 1, wherein said data signals of a first type are RF signals.

7. The system according to claim 1, wherein said first type data signals are RF signals operated with compliance to ZigBee protocol.

8. The system according to claim 1, wherein said wireless device is a hand-held device.

9. The system according to claim 1, wherein said wireless device is a mobile communication device.

10. The system according to claim 1, wherein said wireless device is a mobile phone device.

11. The system according to claim 1, wherein said wireless device is a mobile computer.

12. The system according to claim 1, wherein said second type data signals are Bluetooth protocol compliant signals.

13. The system according to claim 1, wherein said converter unit extracts indication of the distance of each of said at least one tag units from said converting unit.

14. The system according to claim 1, wherein the data signals of the second type include indication on the distance between a tag unit and the converter unit.

15. The system according to claim 1, wherein the wireless device provides audible output responsive to the indication of the distance of each of said at least one tag units from said converting unit.

16. The system according to claim 1, wherein the at least one tag unit is adapted to receive data signals of the first type; the wireless device is adapted to transmit data signals of the second type; and the converter unit further receives the data signals of the second type from the wireless device converts the data signals of the second type from the wireless device to data signals of the first type, and transmits said data signals of the first type to said at least one tag unit.

17. The system according to claim 1 wherein the data signals of the second type are received by the wireless device and are processed by a S/W application that is adapted to run under a programmable OS of the wireless device.

18. An apparatus of converting signals associated with monitoring persons or objects, comprising:

a. a receiver unit for receiving a first type data signals from at least one tag unit that is attached to a person or object that is being monitored and processing data that is derived from said first type data signals;

b. a converter unit for converting the first type data signals to a second type signals;

c. a transmitter unit for receiving data from said converter unit, and transmitting the second type data signals to a wireless device; and wherein the apparatus is portable and is carriable by a monitoring person wherein said converter unit extracts indication of a distance of each of said at least one tag units from said converting unit, based on intensity of the signals that are received from each of said at least one tag unit, and wherein the wireless device displays graphic display responsive to the indication of the distance of each of said at least one tag units from said converting unit.

19. A method of monitoring a location of persons or objects, comprising the steps of:

a. transmitting first type signals from at least one tag unit that is attached to a person or object that is being monitored;

b. receiving the first type signals by a portable converter unit that is carriable by a monitoring person;

c. converting the first type signals into a second type signals; and d. transmitting signals of the second type to a wireless device that is carriable by said monitoring person, wherein the signals of the second type are responsive to the signals of the first type that were received by the converting unit wherein said converter unit extracts indication of a distance of each of said at least one tag units from said converting unit, based on intensity of the signals that are received from each of said at least one tag unit, and wherein the wireless device displays graphic display responsive to the indication of the distance of each of said at least one tag units from said converting unit.

* * * * *